US007563071B2

(12) United States Patent
Campbell et al.

(10) Patent No.: US 7,563,071 B2
(45) Date of Patent: Jul. 21, 2009

(54) PIN-LOADED MOUNTING APPARATUS FOR A REFRACTORY COMPONENT IN A COMBUSTION TURBINE ENGINE

(75) Inventors: Christian X. Campbell, Orlando, FL (US); Douglas A. Keller, Oviedo, FL (US); Malberto F. Gonzalez, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 821 days.

(21) Appl. No.: 11/197,233

(22) Filed: Aug. 4, 2005

(65) Prior Publication Data

US 2007/0031258 A1 Feb. 8, 2007

(51) Int. Cl.
*F01D 11/08* (2006.01)

(52) U.S. Cl. ..... 415/173.1; 416/174; 416/191

(58) Field of Classification Search ..... 415/170.1, 415/173.1, 173.3, 173.4, 173.6, 213.1, 214.1; 416/174, 189, 191

See application file for complete search history.

(56) References Cited

U.S. PATENT DOCUMENTS

| | | | | |
|---|---|---|---|---|
| 4,066,384 | A | 1/1978 | DeFerdinando | |
| 4,245,954 | A | 1/1981 | Glenn | |
| 5,035,573 | A | 7/1991 | Tseng et al. | |
| 5,116,199 | A | 5/1992 | Ciokajlo | |
| 5,201,847 | A | 4/1993 | Whidden | |
| 5,616,001 | A | 4/1997 | Boyd | |
| 5,720,597 | A | 2/1998 | Wang et al. | |
| 5,921,749 | A | 7/1999 | McLaurin et al. | |
| 6,164,903 | A | 12/2000 | Kouris | |
| 6,200,092 | B1 | 3/2001 | Koschier | |
| 6,241,469 | B1 | 6/2001 | Beeck et al. | |
| 6,325,593 | B1 | 12/2001 | Darkins et al. | |
| 6,478,537 | B2 | 11/2002 | Junkin | |
| 6,550,777 | B2 | 4/2003 | Turnquist et al. | |
| 6,648,597 | B1 | 11/2003 | Widrig et al. | |
| 6,709,230 | B2 | 3/2004 | Morrison et al. | |
| 6,758,653 | B2 | 7/2004 | Morrison | |
| 6,896,484 | B2 | 5/2005 | Diakunchak | |
| 6,932,566 | B2 * | 8/2005 | Suzumura et al. | 415/135 |
| 2004/0043889 | A1 | 3/2004 | Campbell | |
| 2004/0047726 | A1 * | 3/2004 | Morrison | 415/116 |
| 2004/0062639 | A1 * | 4/2004 | Glynn et al. | 415/134 |
| 2006/0292001 | A1 * | 12/2006 | Keller et al. | 415/170.1 |

* cited by examiner

*Primary Examiner*—Edward Look
*Assistant Examiner*—Aaron R Eastman

(57) ABSTRACT

An apparatus for mounting a refractory component such as a turbine shroud ring segment (32) with a ceramic core (42) onto a combustion turbine engine structure (34). The ring segment has a ceramic matrix composite skin (40), and optionally, a thermal insulation layer (46). A pin (60) is inserted through a bore (48) in the core and through an attachment bar (54) with ends received in wells (50) in the core. The attachment bar may be attached to a backing member, or tophat (64), by a biasing device (76) that urges the refractory component snugly against the backing member to eliminate vibration. The backing member and refractory component have mating surfaces that may include angled sides (52S, 70). The backing member is attached to the engine structure. Turbine shroud ring segments can be attached by this apparatus to a surrounding structure to form a shroud ring.

14 Claims, 4 Drawing Sheets

PIN-LOADED MOUNTING APPARATUS FOR A REFRACTORY COMPONENT IN A COMBUSTION TURBINE ENGINE

FIELD OF THE INVENTION

This invention relates generally to the field of combustion turbine engines, and more particularly to the use of ceramics and ceramic matrix composite materials in a combustion turbine engine.

BACKGROUND OF THE INVENTION

A combustion turbine engine has a rotating shaft with several circular arrays of radially oriented aerodynamic blades mounted around the circumferences of disks on the shaft. Closely surrounding these blades is a refractory shroud that contains the flow of hot combustion gasses passing through the engine. This shroud must withstand temperatures of over 1400° C. reliably over a long life span. Close spatial tolerances must be maintained in the gap between the blade tips and the shroud for engine efficiency. However, the shroud, blades, disks, and their connections are subject to wide thermal changes during variations in engine operation, including engine shutdowns and restarts. The shroud must insulate the engine case from combustion heat, and it must be durable and abrasion tolerant to withstand occasional rubbing contact with the blade tips.

Ceramics are known to be useful in the inner lining of shrouds to meet these requirements. A shroud is assembled from a series of adjacent rings, each ring having an inner surface typically of one or more refractory materials such as ceramics. Each ring is formed of a series of arcuate segments. Each segment is attached to a surrounding framework such as a metal ring that is attached to the interior of the engine case. However, ceramic components are difficult to attach to other components. Ceramic material cannot be welded, and it is relatively brittle and weak in tension and shear, so it cannot withstand high stress concentrations. It differs from metal in thermal conductivity and growth, making it challenging to attach ceramic parts to metal parts in a hot and varying environment. Thus, efforts are being made to advance technologies for use of ceramic components in combustion turbine engines, including technologies for reliable ceramic-to-metal connections.

An example of this advancement is disclosed in U.S. Pat. No. 6,758,653, which shows the use of a ceramic matrix composite (CMC) member connected to a metal support member. A CMC member using this type of connection can serve as the inner liner of a combustion turbine engine shroud. Ceramic matrix composite materials typically include layers of refractory fibers in a matrix of ceramic. Fibers provide directional tensile strength that is otherwise lacking in ceramic. CMC material has durability and longevity in hot environments, and it has lower mass density than competing metals, making it useful for combustion turbine engine components. However, it is not ideal for components with stress in areas of sharp curvature, because the fiber layers tend to separate from each other during formation and sintering, leaving voids that weaken the material at curves.

BRIEF DESCRIPTION OF THE DRAWINGS

The invention is explained in the following description in view of the drawings that show.

DETAILED DESCRIPTION OF THE INVENTION

Figure 1:
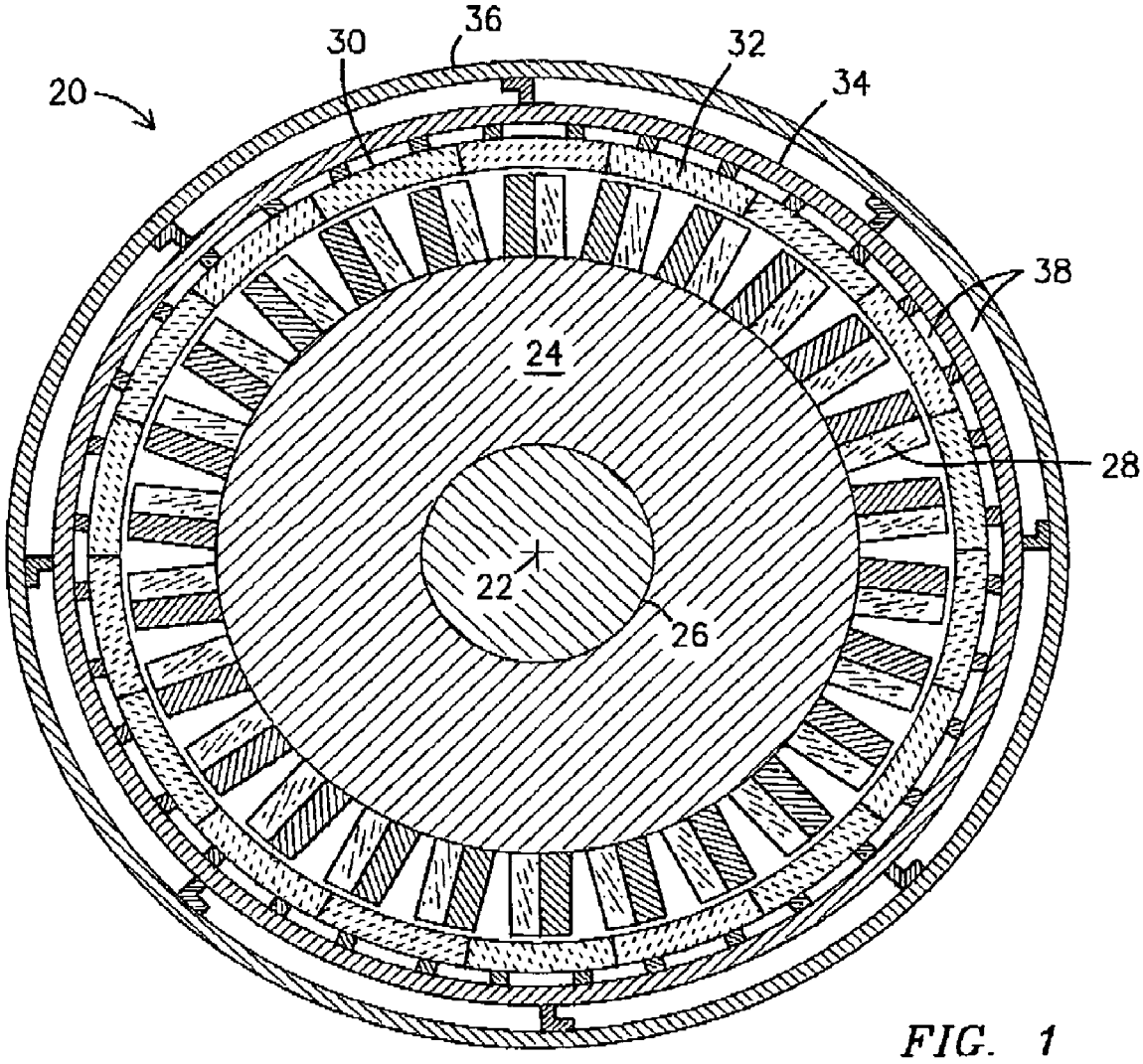
FIG. 1 is a schematic sectional view of a segmented shroud ring in a combustion turbine engine taken on a plane normal to the engine shaft axis.

FIG. 1 shows a schematic sectional view of a combustion turbine engine 20 taken on a plane normal to the engine shaft axis 22 through a disk 24 mounted on the shaft 26 with turbine blades 28 and an associated shroud ring 30 and a support structure. The shroud ring 30 is assembled in arcuate segments 32. The support structure for a shroud ring 30 may comprise an intermediate support ring 34 between the shroud ring 30 and the engine casing 36. The support ring 34 is attached to the engine casing 36, and the segments 32 of the shroud ring are attached to the support ring 34. The support ring 34 and the engine casing 36 may be made of metal, although this is not a requirement of the invention. Cooling air 38 flows between the shroud 34 and engine casing 36 under enough pressure to prevent combustion gases from entering this area through clearances between shroud segments 32. Cooling air may also flow in channels within the blades (not shown). In the following description "axial" means generally parallel to the shaft axis 22; "circumferential" means generally along the circumference of a circle centered on the shaft axis 22 in a plane normal to the shaft axis 22; and "radial" means in a generally perpendicular orientation or direction relative to the shaft axis 22.

Figure 2:
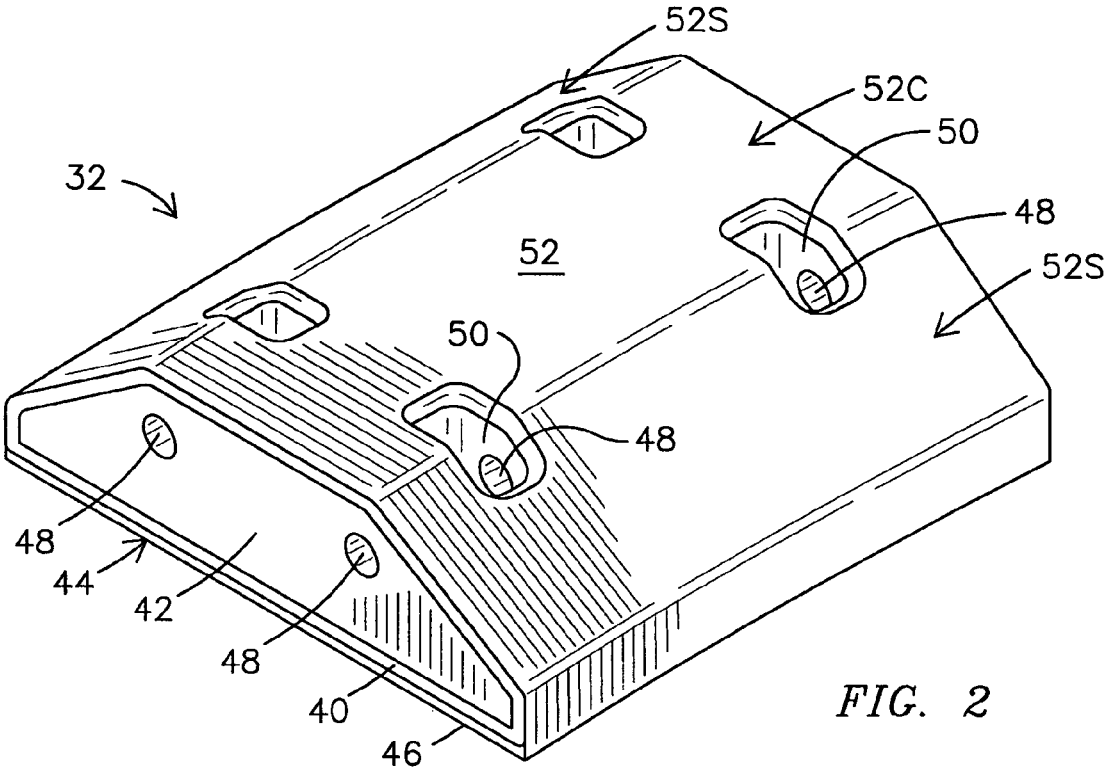
FIG. 2 is an isometric view of a refractory shroud segment.
Figure 3:
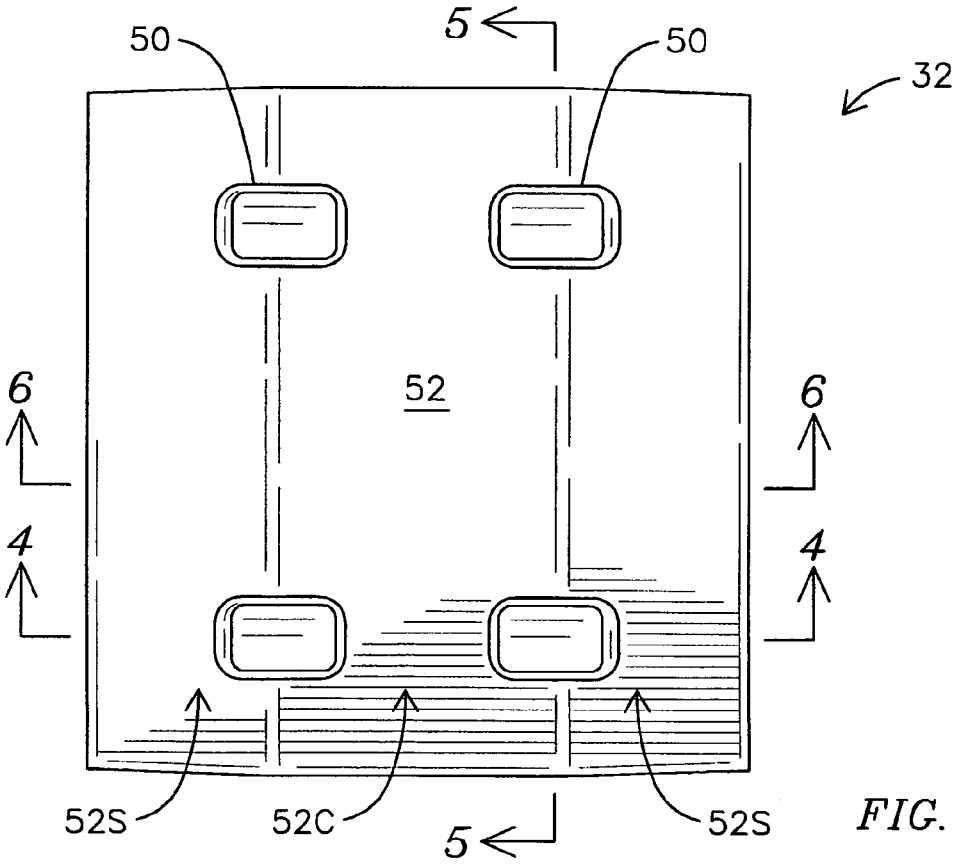
FIG. 3 is a back view of the shroud segment of FIG. 2.

A refractory shroud ring segment 32 of a combustion turbine engine is an exemplary application of the technology of the present invention. This technology can also be applied to other components of combustion turbine engines. FIGS. 2 and 3 show an isometric and top view of a pin-loaded refractory core shroud ring segment 32. The segment 32 is an integrated refractory component having a CMC skin 40 bonded to at least a portion of an exterior surface of a refractory ceramic core 42. The hot side 44 of the segment 32 may be protected by a high temperature thermal insulation 46 deposited on the CMC skin 40.

A wide range of ceramic matrix composites (CMCs) have been developed that combine a matrix material with a reinforcing phase of a different composition (such as mullite/silica) or of the same composition (alumina/alumina or silicon carbide/silicon carbide). The fibers may be continuous or long discontinuous fibers. The matrix may further contain whiskers, platelets or particulates. Reinforcing fibers may be disposed in the matrix material in layers, with the plies of adjacent layers being directionally oriented to achieve a desired mechanical strength. The CMC skin 40 may be a continuously wrapped structure as known in the art of fabrication of composite structures. This means that the fibers are wrapped continuously around the core 42 to avoid discontinuities that cause weak points and unevenness in the skin.

One or more pin bores 48 are formed through the core 42, such as by drilling or by the removal of a fugitive material used during the casting of the ceramic core. The pin bores 48 may be oriented in the circumferential direction as shown, or in an axial direction. An axial pin orientation may facilitate insertion/assembly. Pin access wells 50 are formed into the cold side 52 of the ring segment 32, such as by machining or through the use of a fugitive material, intersecting the pin bores 48. Two such wells 50 intersect each pin bore in the illustrated embodiment.

Figure 4:
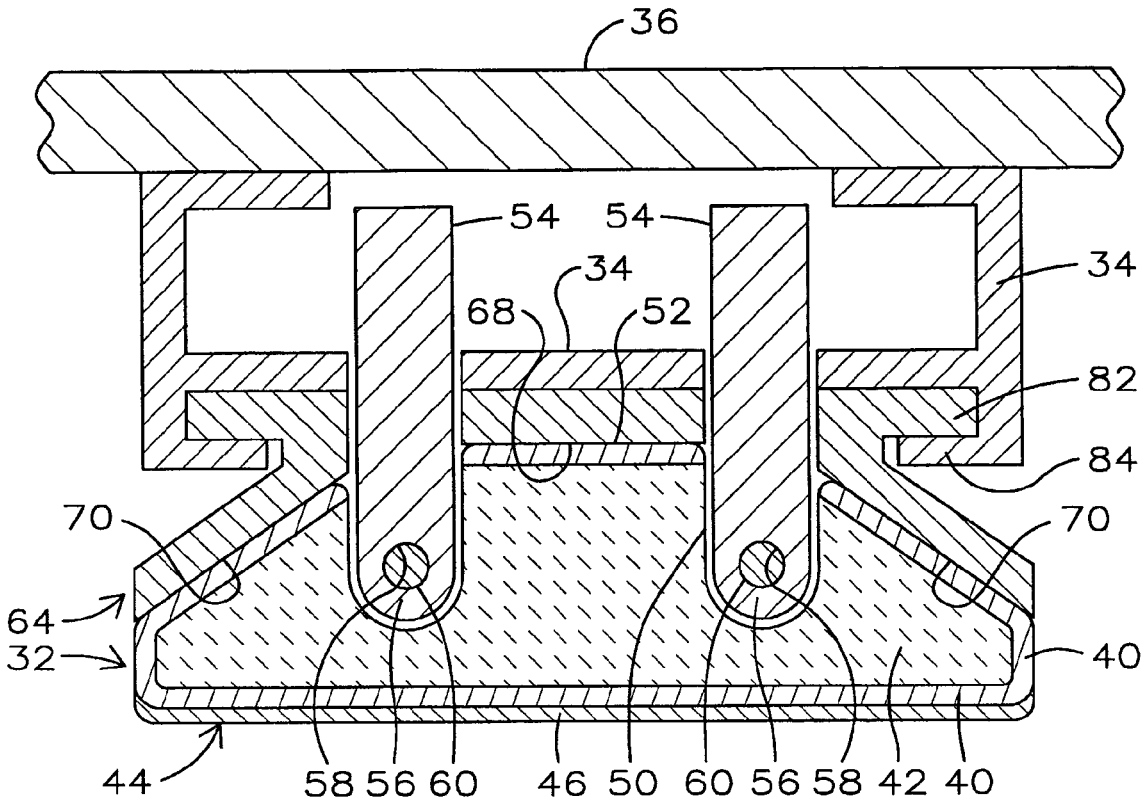
FIG. 4 is a sectional view of the shroud segment mounted in an engine, taken along section 4-4 of FIG. 3
Figure 5:
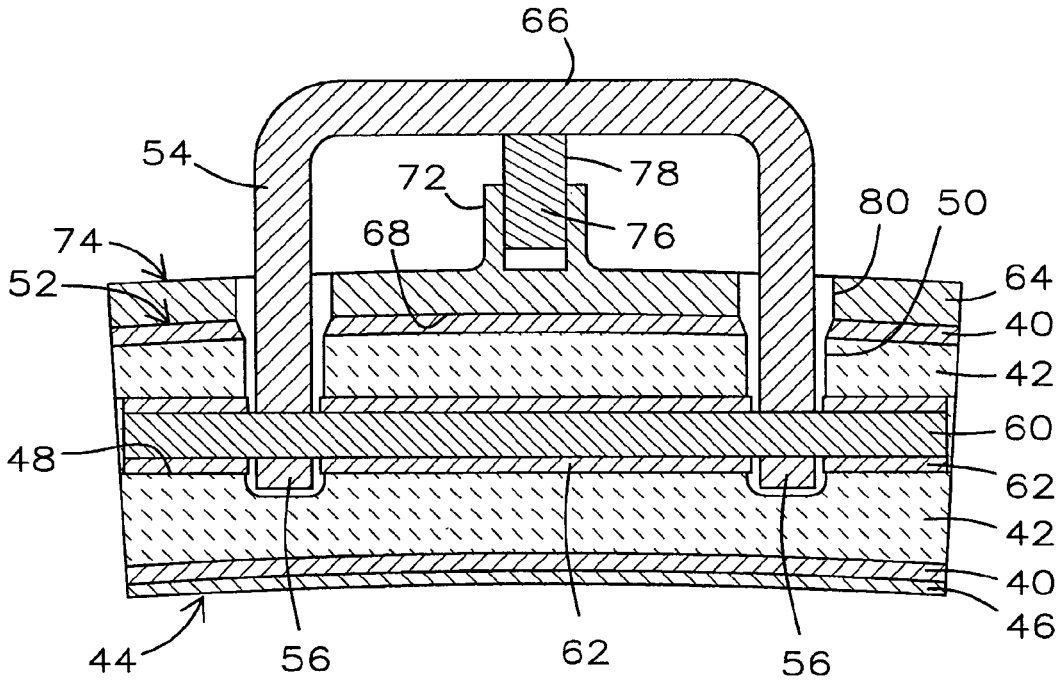
FIG. 5 is a sectional view of the shroud segment and a top hat assembly, taken along section 5-5 of FIG. 3.
Figure 6:
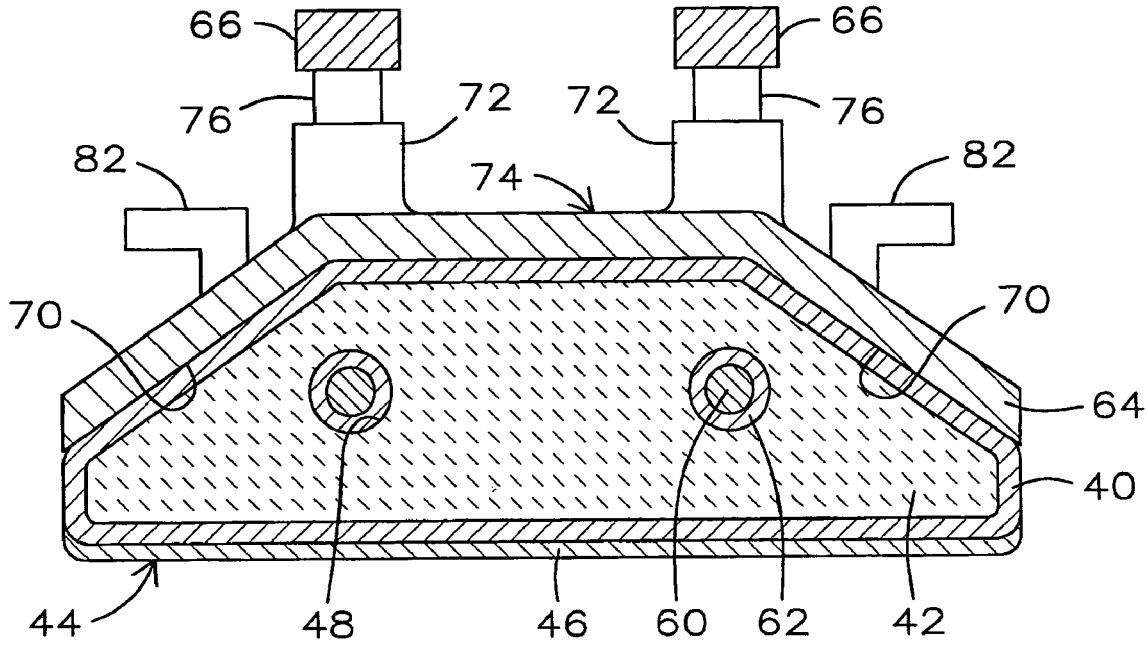
FIG. 6 is a sectional view of the shroud segment and top hat assembly, taken along section 6-6 of FIG. 3.

Additional details of the pin-loaded attachment scheme are shown in FIGS. 4-6. The end of a respective support bar, such as U-shaped clevis bar 54, is inserted into each of the wells 50. The support bars are illustrated as U-shaped clevis bars 54 with each end 56 extending into a well 50 associated with a single bore 48, although one may appreciate that other shapes of support bars are possible in other embodiments. For example, each support bar may have only one end inserted into a well. Each inserted end 56 of the clevis bar has a hole 58 that is aligned with the bores 48. Pins 60 are inserted through the bores 48 and the holes 58 to create a clevis type attachment between the core and the clevis bar 54. Other connection geometries between the bars and pins may be used in other embodiments, such as for example an open J-shaped hook on the bar end for receiving the pin. Support loading between the pin 60 and core 42 is distributed along the entire length of the pin 60. The pin 60 may be sized to fit closely in the bore 48, and the ceramic core 42 is relatively thick and rigid. This combination of geometric features limits the bowing of the pin 60, which would otherwise create point loads rather than a distributed load. To minimize bowing of the pin, two clevis bar attachment points 58 may be spaced symmetrically at intermediate positions along the length of the pin 60, such as 25% to 35% from each end. Since there is a combustion gas pressure drop along the axial direction, and uniform pressure in the circumferential direction, the pins 60 may be oriented in the circumferential direction in order to maintain uniform loading on the pin 60. If the pins are oriented in the axial direction, the clevis support locations may be biased towards the high-pressure side to produce a more uniform load distribution along the length of the pin.

Figure 7:
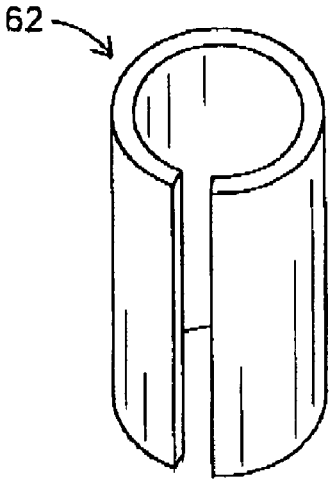
FIG. 7 PRIOR ART
FIG. 7 is perspective view of a prior art slotted spring bushing

The pin bore 48 may have a compliant layer such as bushing 62 to help distribute the pin loading and to protect the metal pin 60 and ceramic core 42 from fretting and sliding wear. An example of a suitable type of bushing is a "slotted spring pin" available from Spirol International, Inc. as shown in FIG. 7. A close fit between the metal of the pin 60 or bushing 62 and the ceramic core 42 will maximize the contact loading area and will help to avoid point contact. An appropriately designed slotted spring bushing 62 enables a close fit tolerance at all temperature conditions by accommodating thermal expansion mismatch between the metal pin 60 and the ceramic core 42 via the spring load. The bushing 62 may be installed in three sections as shown in FIG. 5. This reduces differential thermal expansion along the length of the bushing 62, and allows the holes 58 in the support bars 54 to be sized for the pin diameter. However, the bushing 62 can alternately be in two sections or the full length of the pin if desired, and thereby pass through the support bars 54 along with the pin 60. Thus, the primary wear surface in the support contact area is between the pin 60 and the bushing 62, which is typically a metal-to-metal contact surface. This is preferable to a ceramic-to-metal contact surface and it helps to avoid sliding and fretting wear between the metal pin 60 and the ceramic core 42 due to differential thermal growth of the metal and ceramic.

Such a slotted spring pin may be effective in other high temperature applications where a ceramic structure is attached to a metal structure, such as when a ceramic matrix composite material is supported by a metal support bar inserted through a bore in the CMC material. Should the metal support bar be sized for a tight fit at room temperature, the CMC material defining the bore adjacent to the bar would be crushed at high temperatures by the differential thermal expansion between the metal and the ceramic. This would cause an increase in the size of the bore, resulting in an increasingly loose fit, with subsequent high cycle wear of the CMC material against the metal bar. An intervening spring member allows the metal-to-ceramic fit to remain tight in spite of differential thermal expansion, thereby eliminating dynamic vibration between the CMC and the metal material. Such a design may still experience some localized sliding between the CMC and the metal material as the temperature cycles between room temperature and a high operating temperature, but such wear is low cycle (e.g. $10^2$ cycles) when compared to the high cycle wear (e.g. $10^6$ cycles) experienced by a design not including such a slotted spring pin. This concept may be applied with a pin/bore having a circular cross section, such as illustrated herein, or with a pin/bore having other shapes, such as elliptical, slotted, etc. The concept may further be applied to applications of oxide or non-oxide ceramics, and to monolithic or composite ceramics. Applications may include gas turbine engine components as well as other types of equipment experiencing operation at an elevated temperature.

FIG. 4 shows one embodiment of how a refractory shroud ring segment 32 can be attached to the engine casing 36 via a pin-loaded solid core 42. The cold side 52 of the CMC ring segment 32 cooperates with a metal backing member 64, or "tophat", with a corresponding contoured inner surface 68. In order to keep the CMC ring segment 32 in contact with the metal tophat 64 at all engine conditions for the life of the part, a spring load can be applied to the clevis bars 54 such that the ring segment 32 seats against in the tophat 54. The amount of spring load may be based on the requirements of the design. The upper bound for spring load may be set such that the design of the CMC ring segment 32 has sufficient margin to carry the combined pressure and spring load. The lower bound may be set by the amount of spring load required to keep the CMC ring segment 32 from moving, either due to pressure pulses or to thermal growth mismatches that may allow the structures to separate. The tophat 64 has tabs or hooks 82 that engage with receiving portions 84 on the support ring 34, by sliding engagement, bolts, or other known attachment mechanisms. The support ring 34 is attached to the engine casing 36 as known in the art.

The back surface 52 of the integrated refractory component 32 includes a central generally flat section 52C and two radially-inwardly sloping side sections (surfaces 52S in FIG. 2). Mating sloped surfaces 70 are provided on the tophat inner surface 68. These may be designed such that thermal growth mismatch is accommodated by sliding along these surfaces. A compliant layer (not shown) can optionally be used between the ceramic ring segment 32 and the metal tophat 64. For example, a ceramic fabric can be used, such as Nextel® 440 fiber (aluminum oxide 70%, silicone dioxide 28%, and boron oxide 2%).

FIGS. 5 and 6 schematically illustrate a configuration for attaching the clevis bars 54 to the tophat 64 with a bias that pulls the ring segment 32 against the tophat 64. In this embodiment, a clevis bar 54 is made of a flexible material such as a steel alloy, and is formed in a U-shape with a central span 66. The clevis bars 54 pass through ports 80 in the tophat 64, and extend out the back side 74 of the tophat 64. A boss 72 is provided on the back surface 74 of the tophat. A retention element 76 in the boss supports the midpoint of the central span 66 of the clevis bar 54, bowing it slightly away from the tophat 64. The retention element 76 can be a machine screw threaded into the boss, and adjustably extended against the clevis bar by turning the screw with a wrench. The screw may have a head 78 with a shallow saddle (not shown) in which the bar rests. This locks the screw against loss of adjustment. Optionally, the wells 50 can be axially wide enough to allow the bar to pivot aside from the screw head 78 while pinned, so that the bar can be snapped on and off the saddle without readjustment. The screw/boss threads may be provided with frictional drag means as known in the art, to prevent loss of adjustment. The retention element can alternately be a compression spring filled with a damping material. The clevis bars are not limited to a "U" shape. They can be straight or other shapes. Conventional attachment means may alternately be used for attaching the bars to the supporting structure with or without a bias. For example, the bars can be attached directly to the tophat 64, or directly to the support ring 34 if desired.

Figure 8:
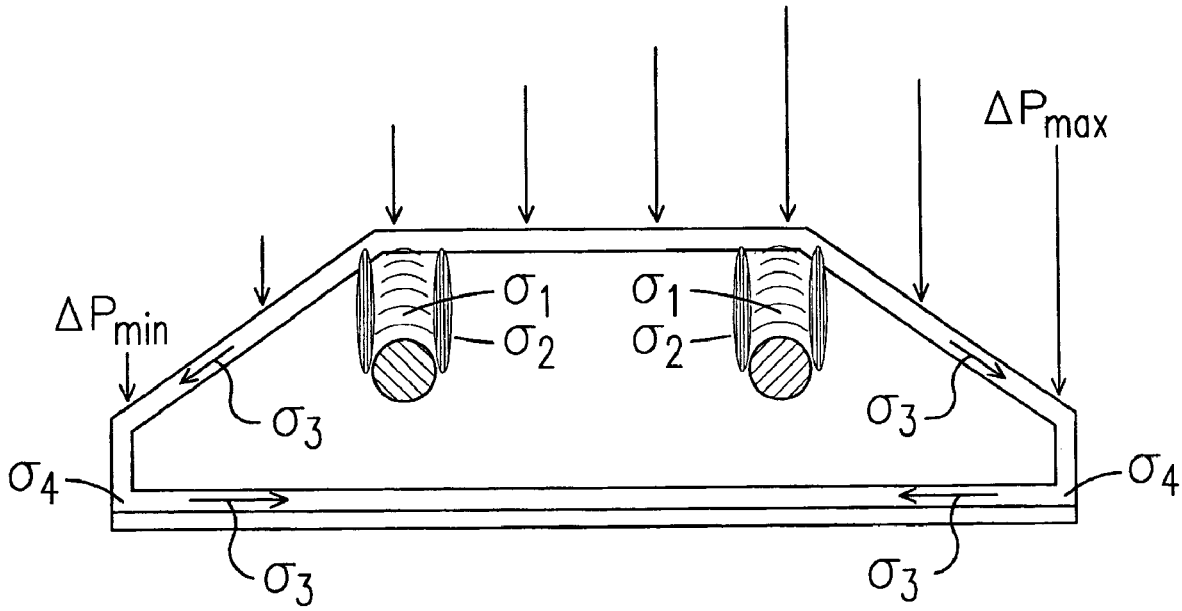
FIG. 8 is a schematic view of pressure load boundary conditions and load paths in a shroud segment

FIG. 8 shows a schematic view of pressure load boundary conditions and load paths for an example pin-loaded core ring segment 32 in an example engine environment. The differential pressure load is the pressure of the cooling air behind the shroud less the pressure of the engine combustion gases. The differential pressure load increases from ΔPmin (example 12.4 psi) to ΔPmax (example 58.4 psi) along the axial direction of the ring segment. As was noted previously, the pins 60 may be oriented in the circumferential direction so that they carry a uniform load along their length. The preload applied by the metal tophat 64 (not shown in FIG: 8) is additive to the pressure load. Bearing stress $\sigma_1$, shear tear-out stress $\sigma_2$, bending stress $\sigma_3$, and corner stress $\sigma_4$ areas are indicated. At the corners there is minimal shear stress, and essentially zero tensile stress, since corners are not in a primary load path. Thus, the load path of the pin-loaded core ring segment 32 is favorable for ceramic materials. The primary paths for carrying the pressure loads are by compressive and shear loading of the ceramic core 42. Since compressive strength of a refractory ceramic core is much greater than its tensile or shear strength, this design aligns the primary strength of the structure with the primary load path of the component. The shear area is quite large and initial calculations show that the shear strength is on the order of a factor of ten greater than the shear load resulting from the pressure stress.

To optimize the design, the bearing stress can be reduced by increasing the diameter of the pins 60, thus increasing the contact area; the shear tear-out stress can be reduced by increasing the diameter of the pins, thus increasing the shear area; and/or the shear tear-out stress can be reduced by locating the bin bores 48 farther from the cold side 52 of the segment 32, thus increasing the shear area. Bending stress on the segment 32 is reduced for two reasons. First, the loading pins 60 may be located at locations that minimize bending stress. Second, the structure is thick, and the CMC/core/CMC cross-section is quite strong in bending since the CMC 40 effectively carries the bending load as a primary membrane stress (either tensile or compressive) in the fiber direction.

Another advantage of the pin-loaded, CMC wrapped core structure is that it minimizes stress in areas that are particularly difficult to fabricate with CMC. CMC manufacturing development efforts have repeatedly shown that it is difficult to achieve good microstructure around a radius of curvature. The problems are related to the difficulties in compacting the fabric around a corner, and to sintering shrinkage anisotropy between the fiber and the matrix. The net result is that the as-manufactured CMC tends to have a level of delamination and void formation around the radius of curvature. This results in low interlaminar tensile and shear strength around sharp curves in a CMC structure. Prior attachment devices based on hooks, pins, or T-joints carry the pressure load as a shear load and a moment at the radius of curvature, which generate an interlaminar shear stress and an interlaminar tensile stress, respectively. In order for these attachment types to be viable, the CMC must possess sufficient interlaminar shear and interlaminar tensile strength to carry such pressure loads with sufficient margin. Even if the manufacturing difficulties were resolved, and the CMC microstructure were perfect, this is not a favorable load path for a 2D laminated CMC material In comparison, the present pin-loaded core concept does not rely on CMC strength around a radius of curvature as a primary load path. First, there is minimal shear stress due to the small bending load. Second, since the core prevents an opening moment at the radius of curvature, there is essentially zero interiaminar tensile stress. Therefore, there is little driving force for delamination cracks to propagate, even if they exist in the as-manufactured CMC. An additional benefit of the pin-loaded core structure is that a continuously wrapped CMC structure may be used to minimize CMC free-edges, which reduces the likelihood of catastrophic delamination cracking, because delaminations are trapped.

The present segment structure is self-constrained against thermal deformations because of its large thickness and due to the complexity of the thermal gradients. There are both positive and negative aspects to the structure being self-constrained. On the negative side, it is unlikely that the structure can deform to relieve the thermal stress. Therefore, all thermal gradients manifest as a corresponding thermal stress, and sometimes these stresses can be quite high. The magnitude of the thermal stress state may be reduced to acceptable levels by the use of a lower stiffness and a highly strain tolerant core material as described in U.S. patent application publication 2004/0043889. On the positive side, it should be easier to control the gas path surface and tip clearances for a self-constrained structure. For structures that deform under a thermal gradient, the blade tip clearances must be set such that blade incursion does not occur at any temperature condition (hot or cold). Therefore, the blade tip clearance must be set according to the closest incursion point of the cycle. At other operating conditions the tip clearance would be greater than necessary. If the ring segment is self-constrained and does not deform, it is not necessary to account for deformations of the ring segment surface, and the blade-tip clearances can be decreased. It is well known that a decrease in blade tip clearance results in an increase in engine performance.

Another advantage of the embodiment described above is its resistance to pressure fluctuations (e.g., caused by a passing blade) and resistance to a blade strike. The resilience of this ring segment concept is related to two features. First, the large mass of the ring segment due to the solid core design will help the structure resist pressure fluctuations and/or impact events by acting as a highly damping material. Second, the ability to apply a significant preload to the structure may help the structure to resist pressure fluctuations and/or impact events.

The following summarizes some of the advantages of the ring segment described above.

- Optimized attachment locations and distributions reduce bending stress.
- Favorable load path for a ceramic material. Pressure load carried by combination of core bearing stress and core/CMC shear stress.
- Load path does not require good CMC properties around the CMC radius of curvature.
- Pin support allows distributed contact load.
- Pin support concept enables the use of a slotted spring pin to achieve a metal-to-metal contact surface at the pin.

Ring segment assembly is attached to the engine by metal hooks 82, 84. There is a high level of confidence in using metal hooks for attachment to the engine (metal-to-metal contact surface).

Attachment hooks 82 on the tophat can be designed to match existing ring segment designs to enable retrofitting.

The metal tophat concept enables the use of a significant level of preload to the CMC ring segment to minimize high cycle fatigue effects driven by pressure fluctuations.

The self-constrained nature of the structure prevents gross deformations of the ring segment. A non-deforming structure allows reduction in the blade tip clearance, and a corresponding increase in engine performance.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

We claim as our invention:

1. An apparatus for use in a combustion turbine engine, the apparatus comprising:

a refractory ceramic core comprising an exterior surface;

a ceramic matrix composite skin bonded to at least a portion of the exterior surface of the core;

the core and skin forming an integrated refractory component;

a bore in the core comprising a length;

a well formed into the refractory component through the exterior surface and intersecting the bore at an intermediate position along the length of the bore;

a support bar comprising a first end in the well;

a pin disposed in the bore and crossing the well at an intermediate position on the pin and connected to the bar; and a tophat contacting a back surface of the refractory component, wherein the support bar extends through an opening in the tophat and is attached to the tophat with a biasing device that urges the back surface of the refractory component against the tophat;

whereby the refractory component is supported by the support bar via the pin.

2. The apparatus of claim 1, further comprising a compliant material disposed between the pin and the core.

3. The apparatus of claim 2, wherein the compliant material comprises a split spring bushing disposed around at least a part of the pin.

4. The apparatus of claim 1, wherein the refractory component comprises a segment of a ring of arcuate segments associated with a path of a blade tip moving within the combustion turbine engine.

5. The apparatus of claim 1, wherein the back surface of the refractory component comprises a central generally flat central section and two radially-inwardly sloping side sections, a front surface of the tophat comprises a geometry that mates with the back surface of the refractory component.

6. The apparatus of claim 1, further comprising a layer of compliant material between the tophat and the refractory component.

7. The apparatus of claim 1, wherein the bore and the pin are disposed generally perpendicular to a shaft axis of the engine.

8. A gas turbine engine comprising the apparatus of claim 1.

9. A shroud ring apparatus for a combustion turbine engine, the apparatus comprising:

a shroud ring segment comprising a refractory ceramic core and a ceramic matrix composite skin bonded to at least a portion of an exterior surface of the core;

a plurality of bores in the core, each comprising a length;

a plurality of wells in a back surface of the ring segment that each intersect a bore at distributed intermediate positions along the length of the respective bores;

a plurality of support bars, each bar comprising a first end received in one of the wells intersecting a particular bore and a second end received in another of the wells intersecting the particular bore, each end of each bar comprising a through-hole that is aligned with the respective bore; and a pin in each bore that passes through the holes in the respective support bars;

a backing member with a front surface abutting the back surface of the ring segment;

the support bars attached to the backing member by a biasing device that urges the ring segment against the backing member; and the backing member comprising an attachment element for connection to a surrounding engine structure.

10. The apparatus of claim 9, further comprising a split spring bushing mounted between each pin and respective bore.

11. A gas turbine engine comprising the apparatus of claim 9.

12. A shroud segment for a gas turbine engine comprising:

a ceramic core;

a ceramic matrix composite material bonded around a surface of the ceramic core to form an integrated refractory component;

a pin disposed within a bore in the ceramic core;

a well extending from a surface of the integrated refractory component to the bore and exposing a portion of the pin;

a support member extending into the well and attached to the pin for supporting the integrated refractory component via the pin;

a tophat disposed against the surface of the integrated refractory component and attached to the support member; and the tophat comprising a support element for attachment to a structure of the engine.

13. The shroud segment of claim 12, further comprising a biasing device urging the tophat and the surface of the integrated refractory component together.

14. The shroud segment of claim 12, wherein the pin comprises a metal alloy, and further comprising a slotted split spring disposed between the pin and the core.

* * * * *